United States Patent [19]

Yoke

[11] Patent Number: 4,642,064

[45] Date of Patent: Feb. 10, 1987

[54] ASSEMBLAGE TOY

[75] Inventor: Hideaki Yoke, Tokyo, Japan

[73] Assignee: Takara Co., Ltd., Tokyo, Japan

[21] Appl. No.: 715,117

[22] Filed: Mar. 22, 1985

[30] Foreign Application Priority Data

Mar. 23, 1984 [JP] Japan ..... 59-56935

[51] Int. Cl.[4] ..... A63H 17/00

[52] U.S. Cl. ..... 446/94; 446/101

[58] Field of Search ..... 446/97, 99, 101, 93, 446/94, 95, 290

[56] References Cited

U.S. PATENT DOCUMENTS

| | | | |
|---|---|---|---|
| 3,740,895 | 6/1973 | Nagasaka | 446/101 X |
| 4,095,367 | 6/1978 | Ogawa | 446/290 X |
| 4,170,840 | 10/1979 | Ogawa | 446/95 |
| 4,206,564 | 6/1980 | Ogawa | 446/94 |
| 4,226,045 | 10/1980 | Lehmann et al. | 446/101 |
| 4,391,060 | 7/1983 | Nakane | 446/94 |

*Primary Examiner*—Mickey Yu

*Attorney, Agent, or Firm*—Price, Gess & Ubell

[57] ABSTRACT

An assemblage toy which includes a robotic humanoid form that can be interconnected with optional assemblage elements is provided. Interconnection recesses and/or projections are provided on the humanoid parts of the robotic assemblage toy and on the optional elements to facilitate the formation of new toy objects.

12 Claims, 14 Drawing Figures

ASSEMBLAGE TOY

BACKGROUND OF THE INVENTION

This invention relates to an assemblage toy and, more particularly, to an assemblage toy which is composed of at least one robotic assemblage element of a robotic humanoid form, having a plurality of projections and recesses on the outer surface and at least one optional assemblage element of one of a variety of different forms, having a plurality of projections and recesses on the outer surface, said elements being connected with one another by engaging with the projections and recesses in a male-female connection, to obtain a variety of assembly forms.

A variety of assemblage block toys composed of a plurality of assemblage block elements have been proposed and fabricated. Such conventional block elements having a doll form are heretofore designed to have functions of a simulated human or the like even when associated with other block elements. Therefore, even when various types of block elements are assembled to make, for example, an automobile, an airplane or a monstrous beast, such an assemblage doll element can be always associated and utilized merely as a simulated human such as a driver for the automobile, a pilot for the airplane or an operator for the monstrous beast. This is because each element is provided with coupling means for connecting with other elements having similar coupling means thereto in a male-female connection, such coupling means being usually formed in a concave or convex portion such as a projection or a recess, and thus, when a number of such concave and convex portions are provided on the surface of the doll element, the figure of the simulated human is lost. However, since the assemblage block toy is fundamentally designed to make various assembly units of various forms by applying a number of assemblage elements, when the assemblage doll elements can be only employed as the simulated human, the assemblage toy play is limited with dullness.

SUMMARY OF THE INVENTION

An object of the present invention is to provide an assemblage toy, free from the above-mentioned drawbacks and disadvantages, which is composed of at least one robotic assemblage element having a robotic humanoid form and at least one optional assemblage element having one of a variety of different forms by assembling these elements with one another in a variety of forms by engaging with projections and recesses formed on their outer surfaces, thereby playing a wide range of assembly of various forms with this toy.

In accordance with one aspect of the present invention, there is provided an assemblage toy comprising at least one robotic assemblage element having a robotic humanoid form, which is provided with a plurality of engage projections and recesses on the outer surface, and a part of which is formed to be rotatable; and at least one optional assemblage element having one of a variety of different forms, which is provided with at least one engage projection or recess on the outer surface, so that said elements may be connected with one another by engaging with the engage projection and the engage recess of the elements in a male-female connection, thereby obtaining a variety of assembly forms.

The foregoing objects and other objects as well as the characteristic features of the invention will become more fully apparent and more readily understandable by the following description and the appended claims when read in conjunction with the accompanying drawings.

DESCRIPTION OF THE PREFERRED EMBODIMENTS

Figure 1:
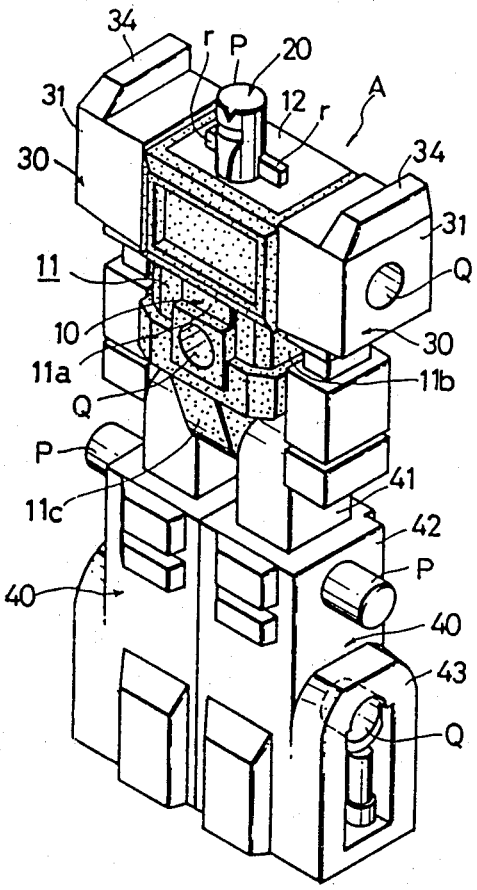
FIG. 1 and 2 are perspective views, seen from the front and the back, showing a robotic assemblage element for forming an assemblage toy according to the present invention.

Preferred embodiments of the present invention will now be described in detail with reference to the accompanying drawings, in which similar reference numerals denote similar components throughout the several views.

Figure 2:
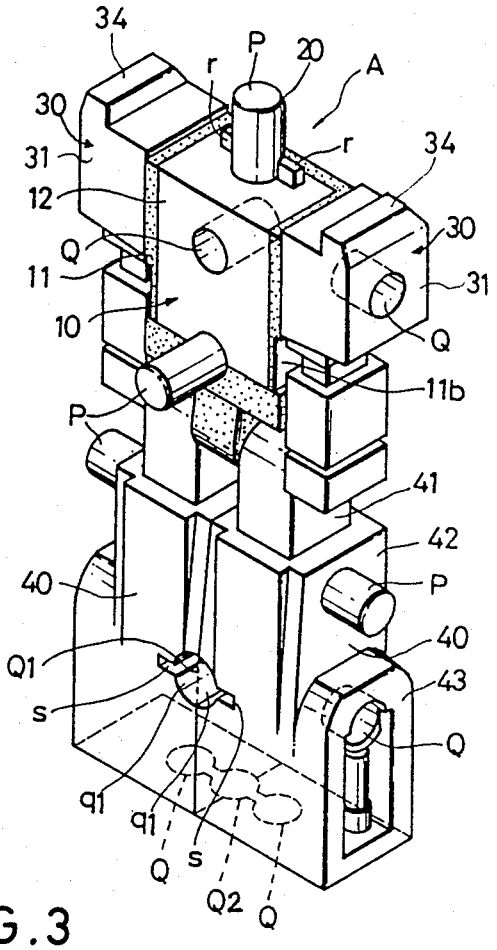
Figure 3:
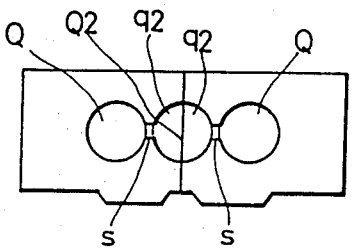
FIG. 3 is a bottom view of the robotic assemblage element of FIG. 1.

In FIGS. 1, 2 and 3, a reference character A designates a robotic assemblage element having a robotic humanoid form. The robotic element A is a composite composed of metal and synthetic resin components, such as a body 10, a head 20 provided on the body 10, arms 30 provided at its right and left sides, and legs 40 provided at its lower portions in such a manner that the arms 30 and the legs 40 are rotatably coupled via hinges to the body 10. The robotic element A also has a plurality of engage convex portions such as projections P and engage concave portions such as recesses Q for a male-female connection at the front and the rear, the right and the left sides, and the top and the bottom.

The structure of the robotic element A will be described further in detail.

Figure 4:
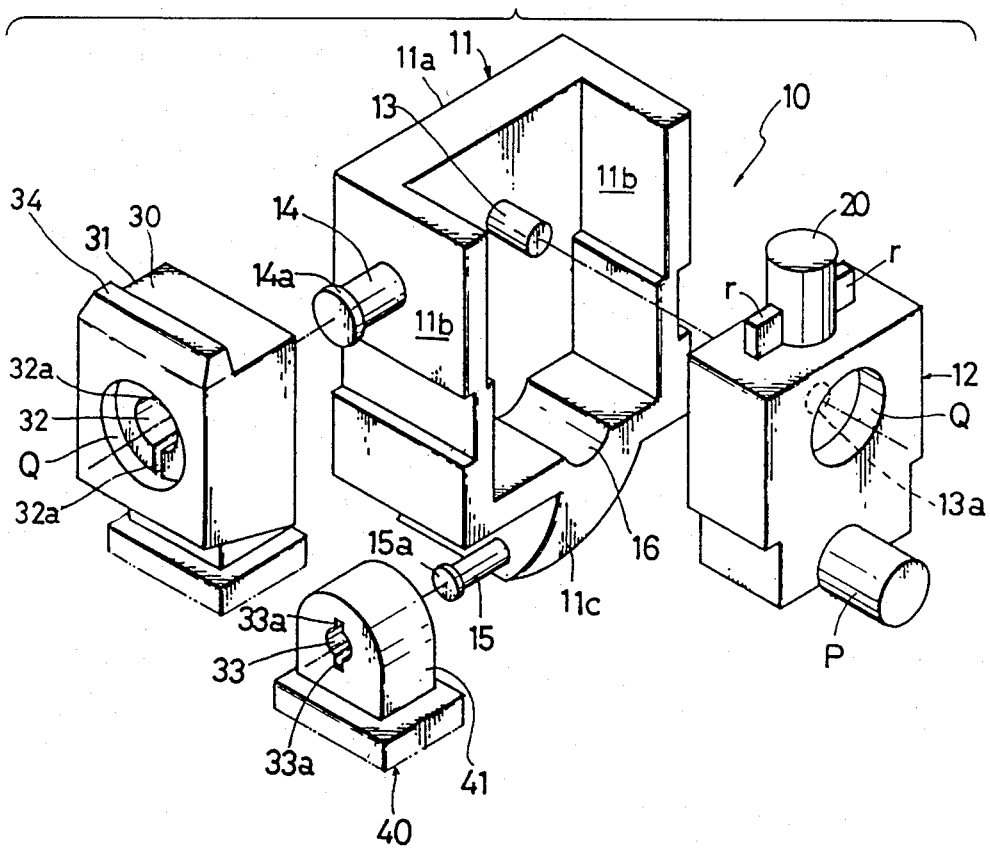
FIG. 4 is an exploded view of the essential components of the robotic assemblage element of FIG. 1.

As shown in FIG. 4, the body 10 comprises a trunk member 11 made of a metallic material and an engage member 12 made of a synthetic resin material, disposed therein, and the trunk member 11 constituting a breast comprises a front wall 11*a* with a recess Q formed on the outer surface and a projection 13 on the inner surface, right and left side walls 11*b* for forming the trunk sides, and a T-shaped base 11*c* for forming a waist in such a manner that a space is formed among the front wall 11*a* and both right and left side walls 11*b*, 11*b*. Two pairs of pivot shafts 14 and 15 project on both sides from the outer surfaces of the both side walls 11*b* and the base 11*c*, and the pivot shafts 14 and 15 have enlarged portions 14*a* and 15*a* on their respective free ends. Further, an engage groove 16 is formed on the upper surface of the base 11*c*. On the other hand, the engage member 12 having a size and a form so as to be engaged within the space of the trunk member 11, has a robotic head 20 at the top, and a recess Q and a projection P on the back surfaces. The lower portion of the projection P of the engage member 12 is protruded downwards. A hole 13*a* for receiving the projection 13 is further formed coaxially in the bottom of the recess Q of the engage member 12. Then, the engage member 12 is disposed in the space of the trunk member 11 by inserting the projection 13 into the hole 13*a* and then the both members 11 and 12 are connected securely by caulking the end of the projection 13 onto the inner wall of the recess Q, thereby forming the body 10. The caulking work can be conducted from the recess Q of the engage member 12, which serves as well a hole of caulking. Thus, the caulked part is not externally exposed, thereby providing a good external appearance. When the engage member 12 is engaged with the trunk member 11, the lower half of the projection P of the engage member 12 is engaged with the engage groove 16 of the trunk member 11, thereby reliably positioning the projection.

The robotic head 20 is provided integrally with the body 10, and its dimensions are designed in a similar manner to those of the projection P, while presenting a face on its front surface. A pair of ribs r are formed on both base sides of the projection P of the robotic head 20.

Figure 5:
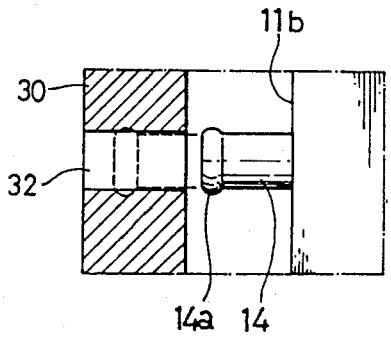
FIG. 5 is an explanatory view for coupling one after another the robotic assemblage elements of FIG. 1.

A pair of the arms 30 are made of a synthetic resin material, and each has a shoulder 31 on the top, and a recesse Q on the outer surface of the shoulder 31. As shown in FIG. 4, a retaining hole 32 having slits 32*a* therealong is formed in the bottom of the recesses Q of the shoulder 31. The arm 30 is rotatably coupled by engaging the pivot shaft 14 projecting from the side wall 11*b* of the body 10 with the retaining hole 32 under a somewhat press-fitting. On this occasion, as shown in FIG. 5, the enlarged end portion 14*a* of the pivot shaft 14 serves as a stop for preventing the arm 30 from the disengagement therefrom.

A pair of the legs 40 are made of a synthetic resin material, and each leg 40 comprises an upper thigh 41, a middle thigh 42 and a lower thigh 43, integrally formed. A hole 33 for receiving the pivot shaft 15, having slits 33*a* therealong is formed in the upper thigh 41, a projection P projects outside from the middle thigh 42, and recesses Q are provided at the outer side and the bottom center of the lower thigh 43. As shown in FIGS. 2 and 3, semicircular grooves ql and q2 are formed at the inside of the front and bottom surfaces of the lower thigh 43. The leg 40 is rotatably coupled to the body 10, as shown in FIG. 4, by engaging the pivot shaft 15 into the hole 33 of the upper thigh 41 in the same manner as the arm 30. When the both legs 40 are closed, the semicircular grooves q1 and q2 of the lower thighs 43 form the recesses Ql and Q2, and a pair of rib retainers s to be engaged with the ribs r of the head 20 are formed at both sides of each recess Q1 or Q2.

Figure 6:
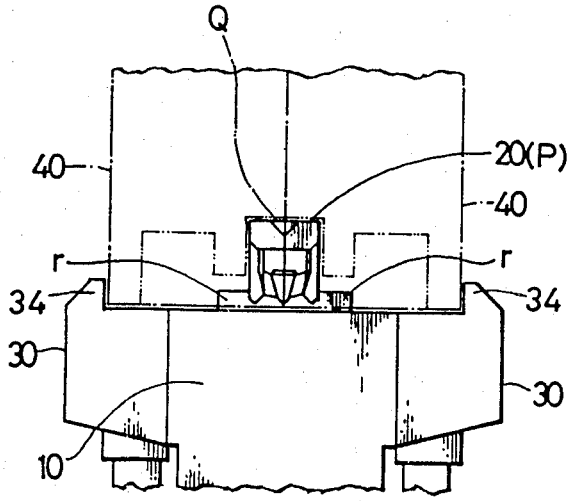
FIG. 6 is an explanatory view for coupling one on another of the robotic assemblage elements of FIG. 1.

Then, as shown in FIG. 6, each shoulder 30 of the robotic element A is provided with a stand portion 34 at its outer side end so that the width of the bottoms of the closed two legs 40 may be substantially equal to and be rightly engaged with the interval between the stand portions 34 of the shoulders 30. Therefore, the two robotic elements A are coupled one on another on the shoulder by engaging the recess Q2 composed of the semicircular grooves q2 at the bottoms of the legs 40 of one robotic element A with the head 20 of another robotic element A as well as engaging the bottoms of the legs 40, 40 of the former with the space between the shoulder stand portions 34 of the latter.

As described above, the robotic element A is composed of the metal and the synthetic resin components and therefore, a heavy-feeling and a manually responsive feeling are provided. The arms 30 and the legs 40 are coupled to the body by engaging the respective pivot shafts 14 and 15 with the holes 32 and 33. In addition, the slits 32*a* and 33*a* are formed in the holes 32 and 33, respectively. Therefore, when the pivot shafts 14 and 15 are engaged with the respective holes 32 and 33, the engaging work can be conducted easily, and no crack occurs in the holes 32 and 33. Further, since the pivot shafts 14 and 15 are engaged within the respective holes 32 and 33 under the somewhat press-fitting, the arms and legs are pivotally moved in moderation, and are maintained in a predetermined attitude. Moreover, since the ribs r are formed on the base sides of the head 20, its strength is increased, and further, when the ribs r are engaged within the rib retainers s for the recess Q, the rotation of the projection P relative to the recess Q can be prevented, thereby obtaining their rigid coupling.

Further, the robotic element A has rotatable arms and rotatable legs relative to the body as well as projections and recesses to be engaged with one another on the outer surface. Therefore, the robotic element A can be detachably coupled to another robotic element A of the same construction by engaging the projection of one element with the recess of another element. Thus, the robotic elements A can be associated one another in various assembly types, and the robotic element A can be associated with other optional assemblage elements of various forms, having the recesses Q and the projections P on the outer surfaces in the same manner, thereby further obtaining a number of variations in the assembly.

Figure 9:
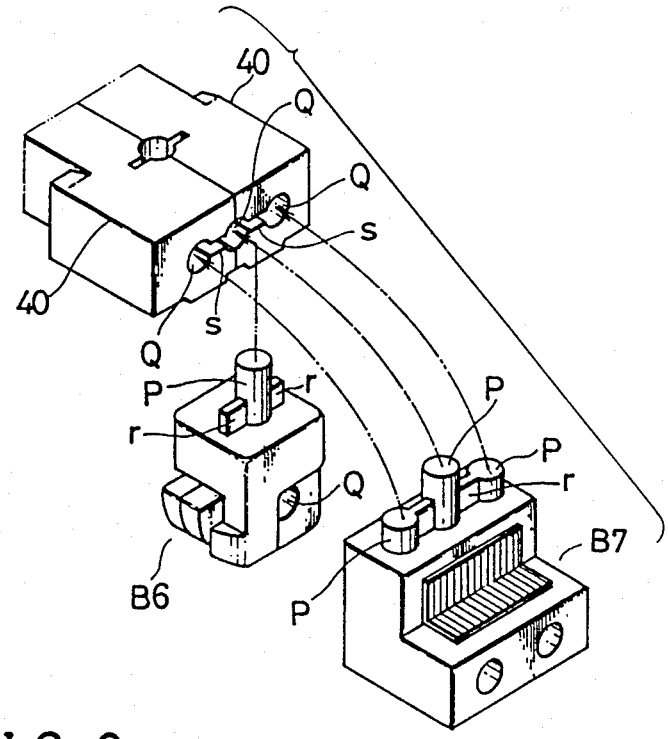
FIG. 9 is an explanatory view for coupling the robotic assemblage elements and the optional assemblage elements to form an assembly of a particular form according to the invention.
Figure 7:
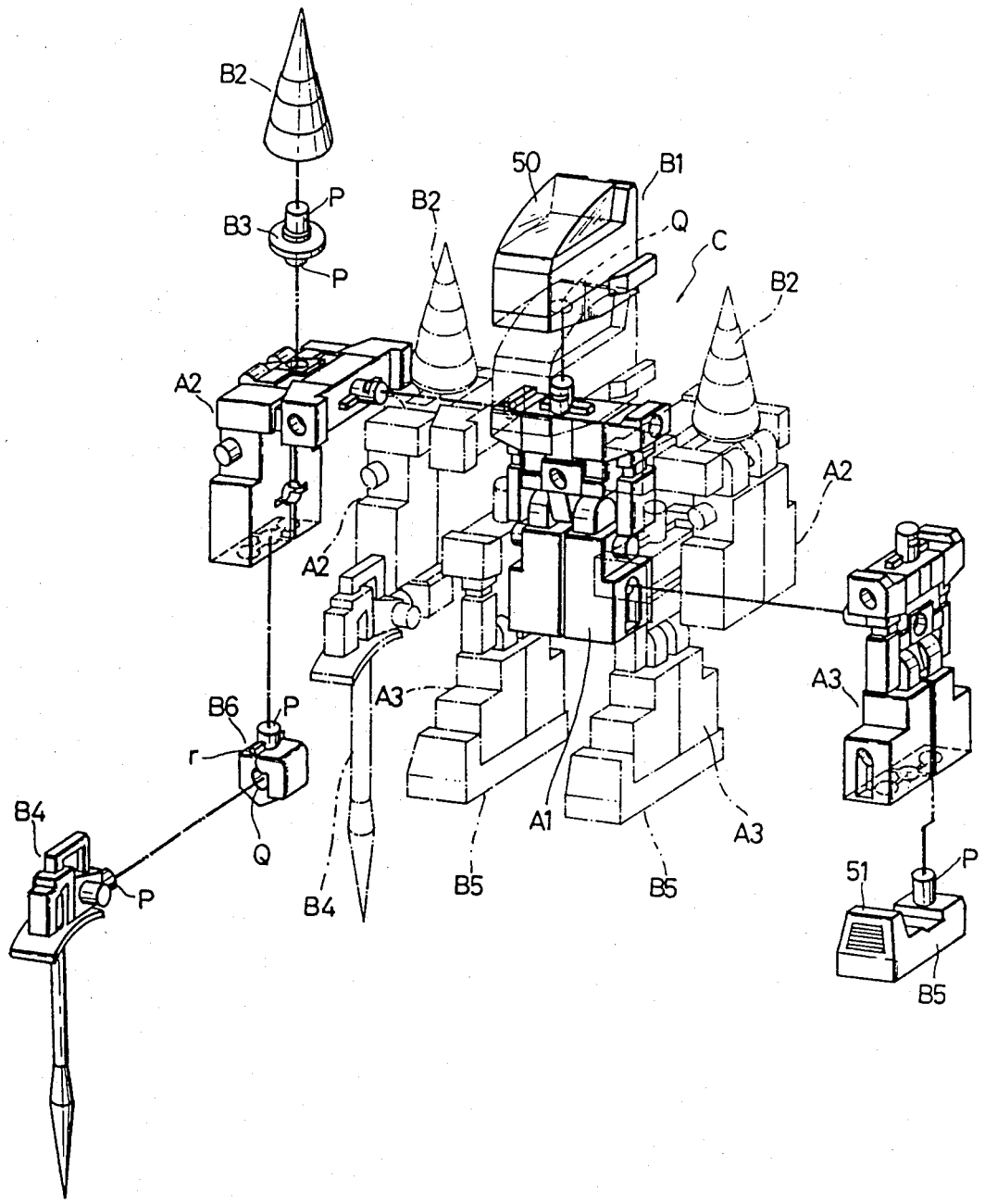
FIGS. 7 and 8(a), 8(b) are explanatory views for coupling the robotic assemblage element of FIG. 1 with optional assemblage elements according to the present invention.
Figure 8A:
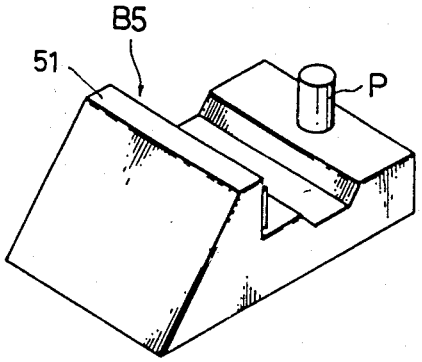
Figure 8B:
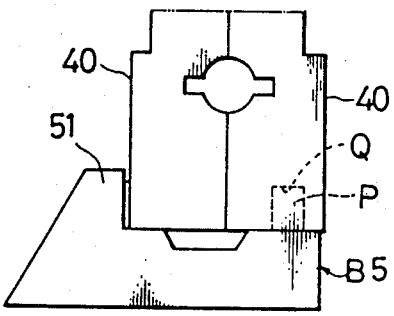

Examples of associating the robotic assemblage element(s) A and other optional assemblage elements will be described with reference to FIGS. 7–13. In FIG. 7, a reference character B1 designates a box-form optional assemblage element having a hatch 50 at the top and a recess Q at the bottom. A reference character B2 denotes a cone-form optional assemblage element having a recess Q on the bottom. A reference character B3 denotes a disk-form optional assemblage element for a joint, having projections P on the top and the bottom. A reference character B4 designates an optional assemblage element having a gun form with projections P on the base. A reference character B5 denotes a leg-form block optional assemblage element having a stand wall 51 and a projection P on the upper surface, as shown in FIG. 8(*a*). As shown in FIG. 8(*b*), the stand wall 51 and the projection P are formed so that the projection P may be engaged with the recess Q of the bottom of one leg 40 of the robotic element A when the side of the other leg 40 thereof is contacted with the inside of the stand wall 51. Thus, the optional element B5 and the robotic element A are coupled to each other reliably and rigidly . A reference character B6 designates a fist-form optional element having a recess Q therein, a wrist projection P and a pair of ribs r at both base sides of the projection P. Therefore, the optional element B6 is able to be engaged with the rib retaining recess Q2 of the robotic element A, as shown in FIG. 9. Of course, when the rib retaining recess is formed on the other elements, the optional element B6 can be also coupled to these elements. Similarly, the projection P constituting the head 20 of the robotic element A has the ribs r, and thus it can be engaged with the rib retaining recess of another robotic element A or of the optional elements. When such a projection P with the ribs is engaged with the rib retaining recess Q in this manner, the coupled elements cannot be turned around the projection P at the engaging portion, but the engagement becomes tight.

The robotic elements A are associated with the optional elements of the above-described constructions, thereby obtaining a large-sized robotic humanoid assembly C, as shown in FIG. 7. In this case, the recess Q of the box-form optional element Bl is inserted into the head projection P of one robotic element A1 to form a head, and the head projections P of another pair of robotic elements A2 are inserted into the recesses Q of the shoulders 31 of the robotic element A1 to form both arms by bending at their waist. Then, the projections on the backs of another pair of robotic elements A3 are further inserted into the recesses of the lower thighs 43 of the robotic elements A1 and the projections of the leg-form block optional elements B5 are inserted into the recesses on the bottoms of the robotic elements A3, to form legs. Then, the projections of the fist-form optional element B6 are inserted into the recesses of the bottoms of the robotic elements A2, to form hands. Thus, a fundamental large-sized robotic assembly C different from the robotic elements A1 to A3 can be formed. Then, the lower projections P of the disk-form optional elements B3 are inserted into the recesses on the backs of the robotic elements A2 constituting the shoulders of the large-sized robotic assembly C, and the recess of the bottom of the cone-form optional elements B2 are engaged with the upper projections of the disk-form optional elements B3 from upside. Next, the projection of the gun-form optional element B4 is further inserted into the recess of the fist-form element B6. As described above, a large-sized robotic humanoid assembly C can be obtained by assembling in combination the robotic elements and the optional elements.

Figure 10:
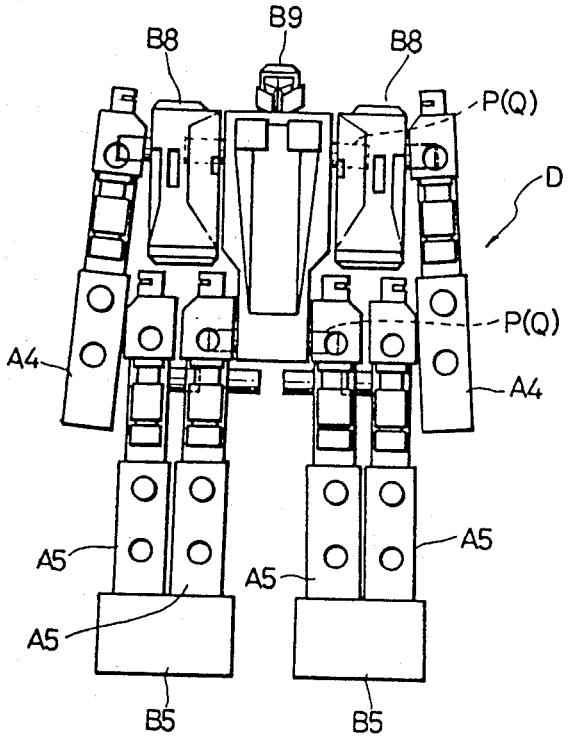
FIG. 10 is an explanatory view of another assembly example assembled according to the present invention.
Figure 11:
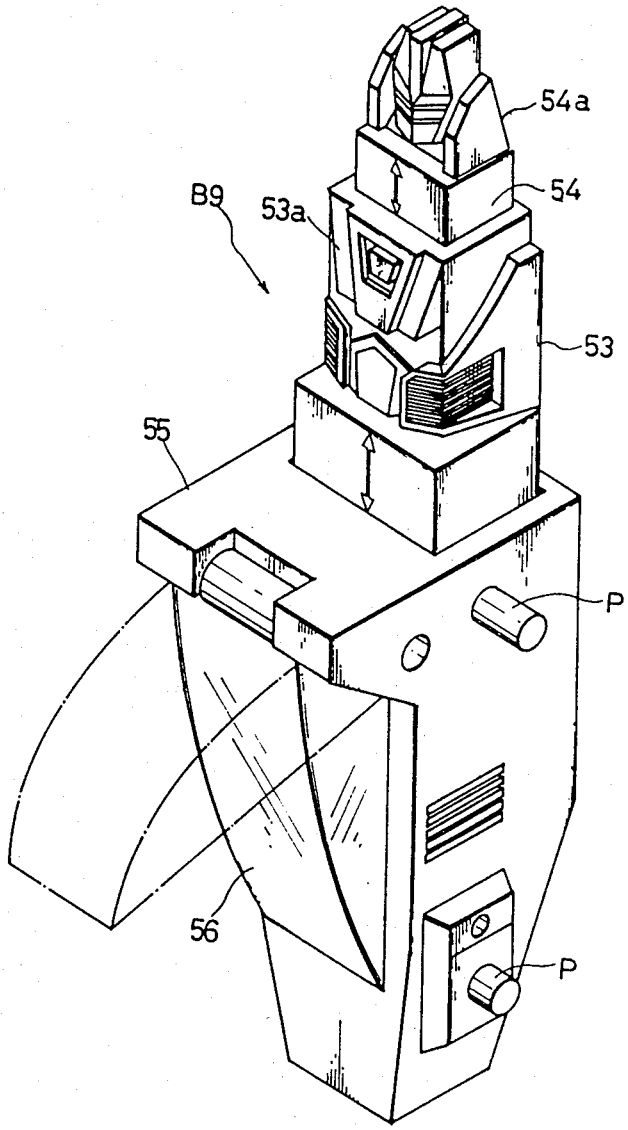
FIG. 11 is a perspective view of the optional assemblage element used for the assembly example of FIG. 10.

Then, another assembly example of the invention is shown in FIG. 10. This example selectively utilizes, in addition to the robotic elements A, optional elements B8, B5 and B9, and they are assembled by inserting and coupling the projections into the recesses of the elements in the same manner as described above, to obtain another robotic humanoid assembly D different from the one of FIG. 7. In this case, the recesses Q of the optional elements B8 constituting the body sides are engaged with both of the projections P of the optional elements B9 constituting a body, and a pair of double robotic elements A5 are coupled to the lower projections P of the optional element B9. Then, a pair of optional elements B5 constituting legs are engaged with the bottoms of the double robotic elements A5 and a pair of the robotic elements A4 constituting arms are engaged with the optional elements B8, thereby providing the assembly D. In this embodiment, the optional element B9 constituting the body has two movable heads 53 and 54, as shown in FIG. 11. In other words, the optional element B9 comprises a body 55 having projections P, a first head member 53 with a first face 53*a* retractable into the body 55 and a second head member 54 with a second face 54*a* retractable into the first head member 53, and either the first or the second head member may be selected by externally drawing out it. Further, a hatch 58 is provided on the front of the body 55, and a driver-form element (not shown) can be introduced therein.

Figure 12:
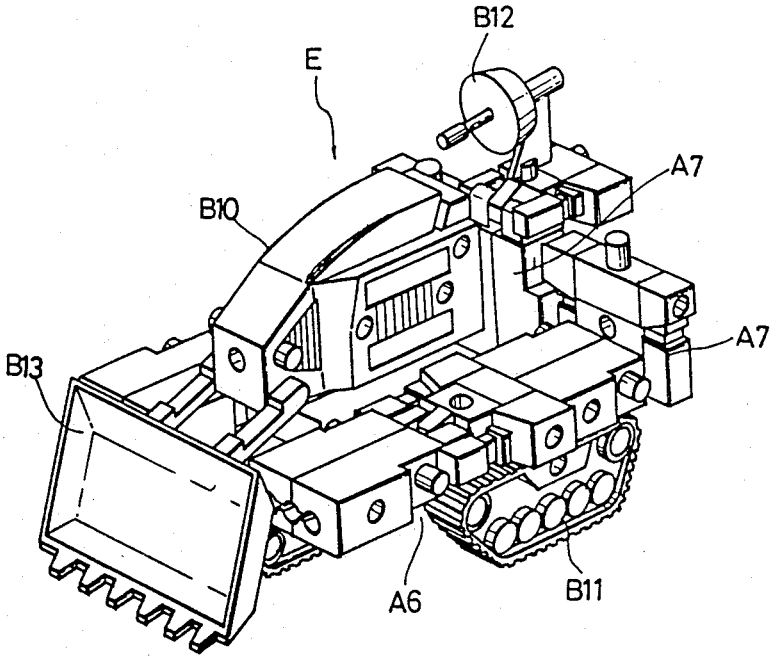
FIGS. 12 to 13 are perspective views of other assembly examples assembled according to the present invention.

Then, still another assembly example of the invention is shown in FIG. 12. This example represents a power shovel form assembly E. This assembly E can be assembled by engaging the projections with the recesses of the robotic elements and the optional elements in the same manner as above. More particularly, the robotic elements A6 and the robotic element A7 are coupled to both of the front lower sides and the rear of an optional element B10 constituting a base, and other robotic elements A7 are coupled to the head of the robotic elements A6 of the front lower sides. Then, crawler-form optional elements B11 are coupled to the bottoms of these robotic elements A6 and A7, and a parabolic antenna-form optional element B12 is coupled to the body of the robotic element A7 of the rear base. Then, arm ends provided at a shovel-form optional element B13 is coupled to the front of the base, thereby obtaining the power shovel-form assembly E.

Figure 13:
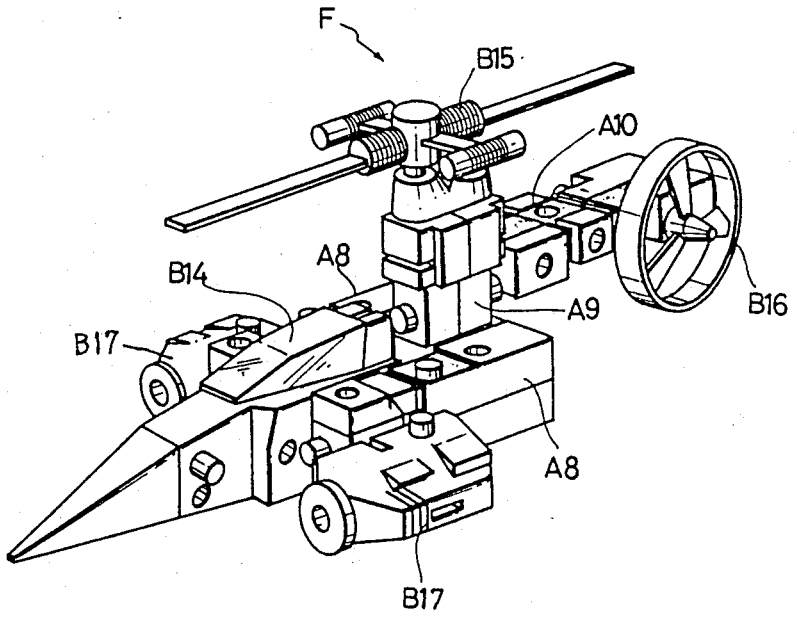

Then, still another assembly example of the invention is shown in FIG. 13. This example shows a helicopter form assembly F. This assembly F can be fabricated by associating the robotic elements and optional elements in the same manner as described above. More specifically, two robotic elements A8 are coupled at both sides of an optional element B14 constituting a base so that the lower parts of the robotic elements A8 may project backwards from the optional element B14, and another robotic element A9 is coupled between the rear parts of the above-described two robotic elements A8. Then, a propeller-form optional element B15 is coupled to the top of the element A9, and still another robotic element A10 is coupled rearwards at a right angle to the robotic element A9. Then, an auxiliary propeller-form optional element B16 is coupled to the rear side of the element A10. Thereafter, a pair of gun-form or engine-form optional elements B17 are coupled to the outsides of the robitc elements A8 arranged at both sides of the base, thereby constructing the helicopter form assembly F.

As described above in detail, the assemblage toy according to the present invention is composed of robotic elements having a plurality of projections and recesses on the outer surfaces, a part of which is constructed to be pivotal, and optional elements of various forms with a plurality of recesses and/or projections on the outer surfaces to be engaged with the projections and the recesses of the other elements. Therefore, since the robotic element having a robotic humanoid form is employed, the recesses and the projections formed on the outer surface do not hurt the visual effect so much, and it not only can be used as a robot but can be coupled with other optional elements, thereby providing various forms of assembly which cannot be found in the prior art, with a result of increasing the range of play. In addition, since the robotic element having the robotic humanoid form constitutes a part of a large-sized robotic humanoid form entirely different therefrom, a fantastic and unexpected change in form can be enjoyed in variations.

What is claimed is:

1. An assembly toy comprising:

a robotic assemblage having a robotic humanoid form including a body, a head mounted to the top of the body, a pair of arms pivotally mounted at the right and the left upper sides of the body, a pair of legs pivotally mounted to the right and the left lower portions of the body and a pair of stand members at both upper sides of the body, the interval between the stand members is substantially equal to that between the outer side ends of the legs;

an optional assemblage element; and interconnecting means for providing a connection to the optional assemblage element, are provided on each of the body, head, arms and legs of the robotic assemblage and include either a projection or a recess, the optional assemblage element includes a complementarily interconnecting means to enable attachment to the robotic assemblage.

2. An assembly toy comprising:

a robotic assemblage having a robotic humanoid form including a body, a head mounted to the top of the body, a pair of arms pivotally mounted at the right and the left upper sides of the body, and a pair of legs pivotally mounted to the right and the left lower portions of the body;

a box-form optional assemblage element having a hatch at the top and a recess at the bottom;

a second cone-form optional assemblage element having a recess on the bottom;

a third disk-form optional assemblage element having projections on the top and the bottom;

a fourth gun-form optional assemblage element having a projection;

a fifth leg-form block optional assemblage element having a stand wall and a projection on the upper side;

a sixth fist-form optional assemblage element having a recess therein, a wrist projection and a pair of ribs at both sides of the projection, the optional assemblage elements can be assembled with one another to form a large-sized robotic humanoid form assembly in combination with the robotic assemblage; and interconnecting means for providing a connection to any optional assemblage element, are provided on each of the body, head, arms and legs of the robotic assemblage and include either a projection or a recess, the optional assemblage elements include a complementarily interconnecting means to enable attachment to the robotic assemblage.

3. An assembly toy comprising:

a robotic assemblage having a robotic humanoid form including a body, a head mounted to the top of the body, a pair of arms pivotally mounted at the right and the left upper sides of the body, and a pair of legs pivotally mounted to the right and the left lower portions of the body;

a body-form optional assemblage element having two movable heads on the top and a hatch on the front;

a second body side-form optional assemblage element;

a third leg-form block optional assemblage element having a stand wall and a projection on the upper side, the optional assemblage elements can be assembled with one another to form another large-sized robotic humanoid form assembly in combination with the robotic assemblage; and interconnecting means for providing a connection to any optional assemblage element, are provided on each of the body, head, arms and legs of the robotic assemblage and include either a projection or a recess, the optional assemblage elements include a complementarily interconnecting means to enable attachment to the robotic assemblage.

4. An assembly top comprising:

a robotic assemblage having a robotic humanoid form including a body, a head mounted to the top of the body, a pair of arms pivotally mounted at the right and the left upper sides of the body, and a pair of legs pivotally mounted to the right and the left lower portions of the body;

a base-form optional assemblage element;

a second crawler-form optional assemblage element;

a third parabolic antenna-form optional assemblage element;

a fourth shovel-form optional assemblage element, the optional assemblage elements can be assembled with one another to form a power shovel form assembly in combination with the robotic assemblage; and interconnecting means for providing a connection to any optional assemblage element, are provided on each of the body, head, arms and legs of the robotic assemblage and include either a projection or a recess, the optional assemblage elements include a complementarily interconnecting means to enable attachment to the robotic assemblage.

5. An assembly toy comprising:

a robotic assemblage having a robotic humanoid form including a body, a head mounted to the top of the body, a pair of arms pivotally mounted at the right and the left upper sides of the body, and a pair of legs pivotally mounted to the right and the left lower portions of the body;

a base-form optional assemblage element;

a second propeller-form optional assemblage element;

a third auxiliary propeller-form optional assemblage element;

a fourth gun-form optional assemblage element, the optional assemblage elements can be assembled with one another to form a helicopter-form assembly in combination with the robotic assemblage; and interconnecting means for providing a connection to any optional assemblage element, are provided on each of the body, head, arms and legs of the robotic assemblage and include either a projection or a recess, the optional assemblage elements include a complementarily interconnecting means to enable attachment to the robotic assemblage.

6. An assembly toy comprising:

a robotic assemblage having a robotic humanoid form including a body, a head mounted to the top of the body, a pair of arms pivotally mounted at the right and the left upper sides of the body, and a pair of legs pivotally mounted to the right and the left lower portions of the body;

an optional assemblage element; and interconnecting means for providing a connection to the optional assemblage element, are provided on each of the body, head, arms and legs of the robotic assemblage and are also provided at the bottom of the legs and adjacent the side of the head, the interconnecting means include either a projection or a recess, the optional assemblage element includes a complementarily interconnecting means to enable attachment to the robotic assemblage.

7. An assemblage toy comprising:

a robotic assemblage, formed of metal and synthetic resin component parts, having a robotic humanoid form including a body, a head mounted to the top of the body, a pair of arms pivotally mounted at the right and the left upper sides of the body, and a pair of legs pivotally mounted to the right and the left lower portions of the body, the metal component part is substantially a hollow box configuration with two open sides and the synthetic resin component is mounted within the metal component part and provides the humanoid head;

an optional assemblage element; and interconnecting means for providing a connection to the optional assemblage element, are provided on each of the body, head, arms and legs of the robotic assemblage and include either a projection or a recess, the optional assemblage element includes a complementarily interconnecting means to enable attachment to the robotic assemblage.

8. In a construction assembly toy that permits a child to combine individual construction elements to build various toy configurations, the improvement comprising:

a plurality of identical toy elements having a simulated robotic humanoid form including a body, a head member mounted to the top of the body, a pair of arm members pivotally mounted at the right and the left upper sides of the body, and a pair of leg members pivotally mounted to the right and the left lower portions of the body including a recess in the bottom of each leg member, and a third recess formed between each leg member when aligned together, each leg member forming a half of the recess wall on its inside bottom surface adjacent the other leg member; and interconnecting means for providing a removable connection of the toy elements is provided on each of the body, head member, arm members, and leg members of the robotic form, and include either a projection or a complimentary recess of the same dimension as the projection to permit a frictional fitting.

9. The invention of claim 8 wherein the head member has a cylindrical configuration to define a projection of a dimension to frictional fit within an interconnecting recess.

10. The invention of claim 8 wherein a recess and a projection are formed on the rear surface of the body.

11. The invention of claim 8 further including a recess formed between each leg member when aligned together, each leg member forming a half of the recess wall on its rear surface adjacent the other leg member.

12. The invention of claim 11 wherein the body, arm members and leg members are of a rectangular configuration.

* * * * *